United States Patent [19]

Nadeau

[11] Patent Number: 4,705,268

[45] Date of Patent: Nov. 10, 1987

[54] TOY EXERCIZING MACHINE FOR CHILDREN

[75] Inventor: Richard P. Nadeau, Frankfort, N.Y.

[73] Assignee: Zorcom Enterprise, Inc., Utica, N.Y.

[21] Appl. No.: 806,339

[22] Filed: Dec. 9, 1985

[51] Int. Cl.[4] ..... A63B 69/06

[52] U.S. Cl. ..... 272/72; 272/DIG. 5; 446/397

[58] Field of Search ..... 272/72, 93, 130, 131, 272/DIG. 5; 446/397, 486; 73/379, 380, 381; 434/247

[56] References Cited

U.S. PATENT DOCUMENTS

D. 277,304 1/1985 Smith et al. ..... 272/72 X
3,995,492 12/1976 Clynes ..... 73/379
4,191,370 3/1980 Meyer et al. ..... 272/130 X
4,230,317 10/1980 Breslow et al. ..... 446/397 X
4,284,272 8/1981 Evans et al. ..... 272/72

*Primary Examiner*—Richard J. Apley
*Assistant Examiner*—J. Welsh
*Attorney, Agent, or Firm*—Shlesinger, Arkwright, Garvey & Fado

[57] ABSTRACT

A child's exercise toy includes a beam member receiving first and second support legs. The first support leg has two child foot supports associated therewith. A seat is slidably mounted along the beam member and an exercise bar is pivotally mounted with respect to the beam member. A digital display counter counts the number of strokes of the exercise bar. Each stroke is signalled at both ends by a pleasing electronic tone.

18 Claims, 10 Drawing Figures fig 6
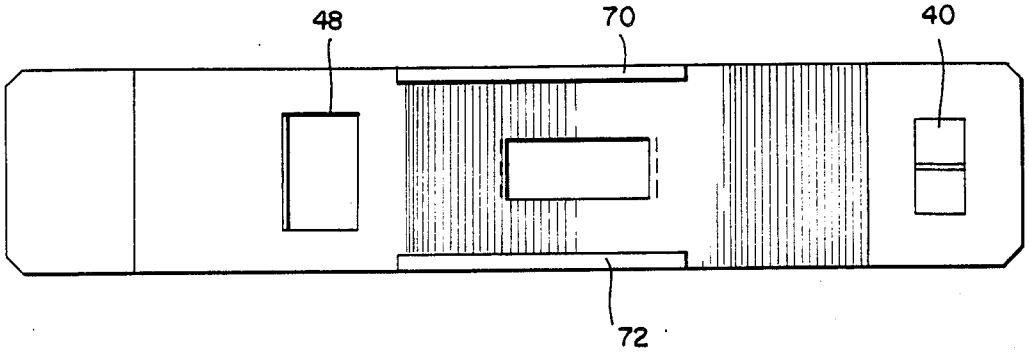
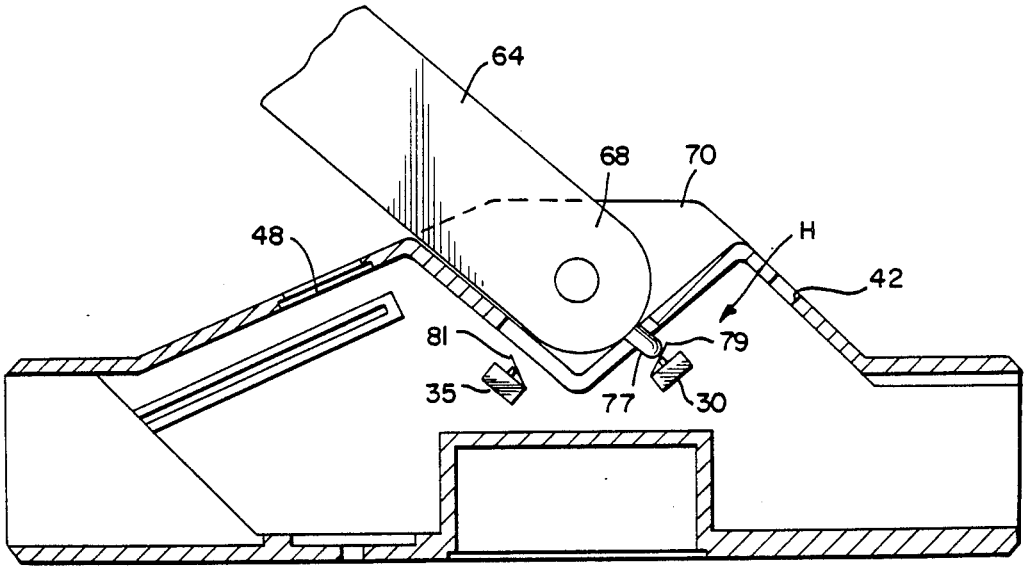
fig 7

TOY EXERCIZING MACHINE FOR CHILDREN

BACKGROUND OF THE INVENTION

Various devices have been developed for providing adults a convenient and inexpensive way to get needed exercise. A typical adult exercise machine or rowing machine is formed of metal thereby, insuring that the machine will support the person using it. This metal, often makes the device heavy and difficult to move. Such devices often include elobarate adjustments for changing the difficulty of the exercise, accomodating different sized people and for collapsing the device so that it may be stored in a compact manner. The various knobs, levers, pins, exposed metal edges and exposed bolt ends make these devices potentially dangerous for children to use. Adult exercise machines are almost always too heavy and complicated for a child to use and enjoy.

OBJECTS AND SUMMARY OF THE INVENTION

It is an object of this invention to provide a safe, light, inexpensive to manufacture and fun to use, exercise machine for children.

Another object of the invention is to provide an exercise machine which produces sounds when the device is used.

Another object of the invention is to provide an exercise machine or rowing machine having a light weight central tubular plastic support, support feet transverse to the central tubular plastic support having an elbow portion and a socket means associated with the central tubular plastic support, for receiving the elbow portion.

Still another object of this invention is to provide an exercise bar support wherein the exercise bar may be be moved between a first position and a second position.

Another object of this invention is to provide an exercise machine for displaying the number of times an exercise bar is moved between a first position and a second position and back to the first position.

Yet another object of the invention is to provide an exercise machine having a safe to use inexpensive to manufacture and light in weight adjustment means for adjusting the force needed to move an exercise bar between a first position and a second position.

Another object of the invention is to provide an exercise machine having a plastic seat which is slidably supported by a plastic tubular beam.

Another object of the invention is to provide a rowing machine, having a seat slidingly supported by a beam, including plastic parts which provide substantially frictionless contact between the seat and the beam.

Still another object of the invention is to provide a rowing machine which is stable and which has built in child safety features.

Still another object of the invention is to provide a rowing machine having smooth surfaces with no exposed bolts or levers.

A further object of this invention is to provide an exercise machine having a light weight tubular support beam which is made of two plastic parts which snap together.

Yet a further object of this invention is to provide a rowing machine having a central tubular beam formed of plastic which houses an electrical processing unit, a digital display, a battery or power supply, a loud speaker and which has an exercise bar support and exercise bar adjustment device integral therewith.

In summary, this invention relates to a child's exercise machine including a beam member formed of plastic or the like, the first support leg having a projection portion, a second support leg having a projection portion, first and second socket means, associated with the beam for receiving respective first and second projection portions. A bracket member, integral with the beam, is provided for supporting an exercise bar. The exercise bar is movable between a first and a second position. A detection device is provided for detecting when the exercise bar has reached the first position and for detecting when the exercise bar has reached the second position. A seat is provided which is slidably mounted on the beam. A loud speaker or the like is provided for producing a first sound when the detecting device has detected that the exercise bar is in the first position. The loud speaker produces a second sound when the detecting device has detected that the exercise bar is in the second position. A counter is also provided to count the number of times the exercise bar has reached the first position or in the alternative the number of times the exercise bar has reached the second position.

These and other objects and advantages of the invention are readily apparent in view of the following description and drawings of the above-described invention.

DESCRIPTION OF THE DRAWINGS

The above and other objects and advantages and novel features of the present invention will become apparent from the following detailed description of the preferred embodiment of the invention illustrated in the accompanying drawings, wherein:

FIG. 6 is a top plan view of the exercise support of the exercise device of the invention;

FIG. 7 is a cross-sectional view taken along the sections 7—7 of FIG. 5;

DESCRIPTION OF THE PREFERRED EMBODIMENT

Figure 1:
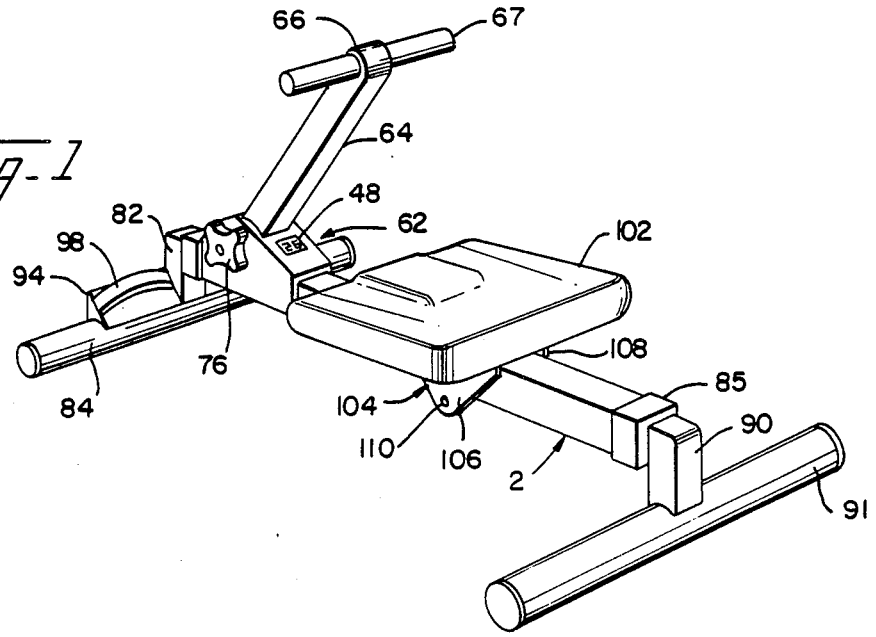
FIG. 1 is a perspective view of the exercise device of the invention.
Figure 2:
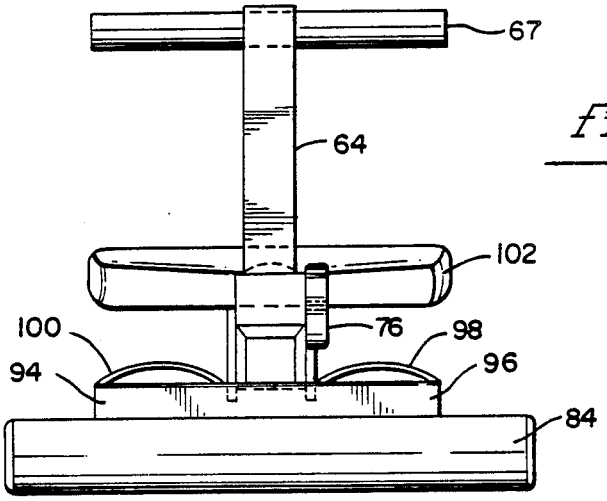
FIG. 2 is a front elevational view of the exercise device of the invention.
Figure 3:
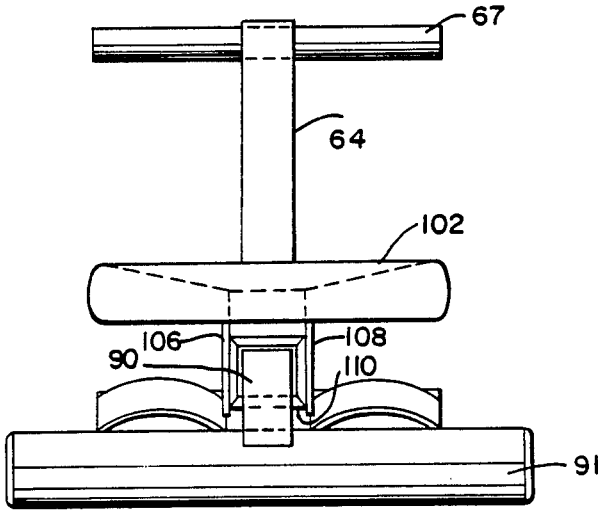
FIG. 3 is a rear elevational view of the exercise device of the invention.
Figure 4:
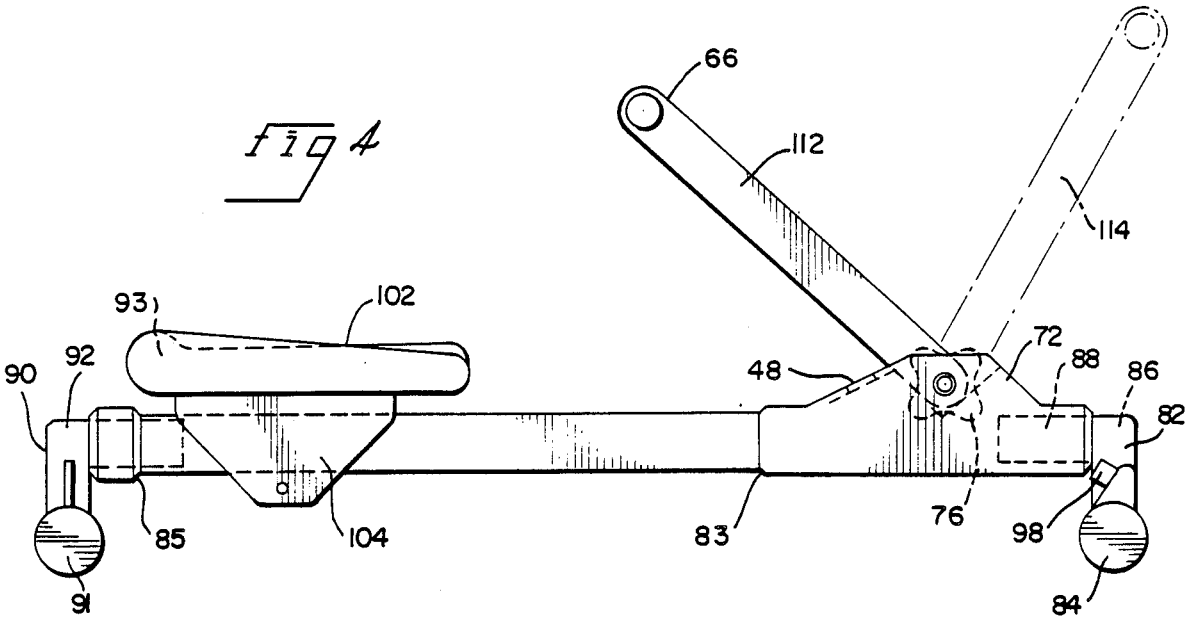
FIG. 4 is a side view of the exercise device of the invention.
Figure 5:
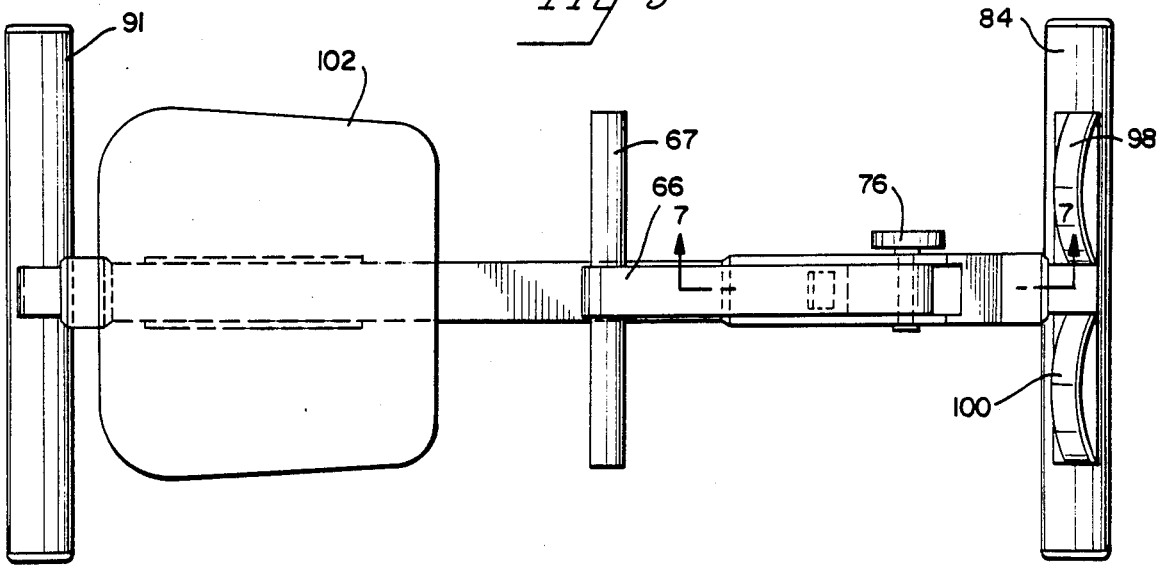
FIG. 5 is a top plan view showing the exercise device of the invention.
Figure 8:
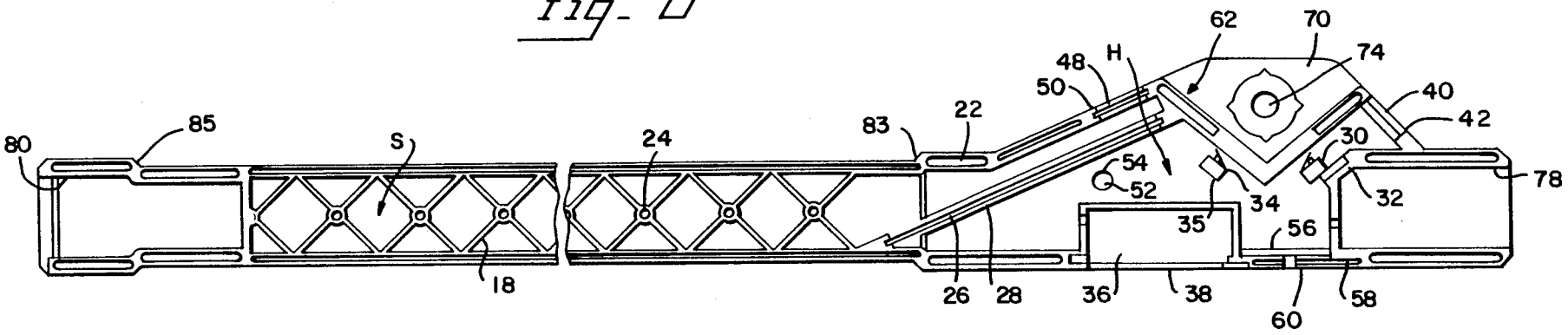
FIG. 8 is a side view of a central beam member which forms part of a central beam.
Figure 9:
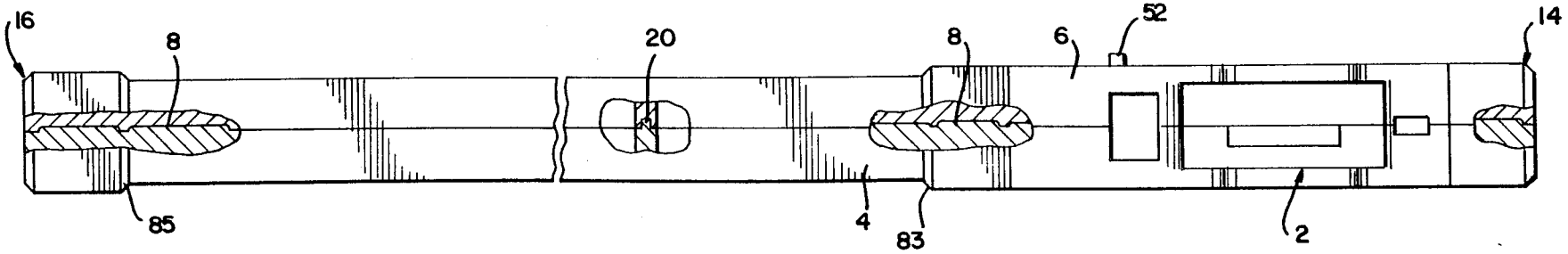
FIG. 9 is a top plan view of a central beam with a portion cut out showing how the beam portions are put together.

A central plastic beam or central tubular plastic support 2 is formed of a first beam part 4 and a second beam part 6. The first part 4 is molded into a shape so as to have a plurality of protuberances or tongues 8 along its upper edge 10 and lower edge 12. Beam 2 has a first end 14 and a second end 16. Between the first end 14 and second end 16 various electrical components are housed in a housing area H. Adjacent the housing area H is a structurally reinforced portion S having a plurality of structural members 18. Associated with the structural member 18 is a protuberance or tongue 20.

The second beam part 6 is substantially a mirror image of the first beam part 4 with the major exception being that slots 22 are provided instead of proturberances or tongues 8 and holes 24 are provided instead of protuberances 20. First beam part 4 and second beam part 6 snap together by means of protuberances 8, protuberances 20, slots 22 and holes 24 similar to a tongue and groove effect.

Housing area H may be filled with various electronic components which may be placed within housing area H before first beam part 4 and second beam part 6 are snapped together. Of course these parts may also be glued, welded or the like. A processing unit or digital logic board 26 is positioned within a processing unit slot 28. Processing unit slot 28 is formed by first beam part 4 and second beam part 6. A counting switch or count detector device 30 is positioned within a counting switch cabin 32. An additional counting switch 35 may be provided in additional counting switch cabin 34. A battery housing 36 is provided on the lower side of beam 2 and includes an access opening 38 for gaining access to interior of the battery housing 36. An on/off switch 40 is provided in on/off switch housing 42. Housing 42 is preferably placed adjacent bracket 44. In this position, on/off switch 40 is easily operatable by the child using the exercise device. Digital display or numeral display 48 is positioned within window 50 defined by beam 2. The position and inclination of window 50 and therefore digital display 48 are such that the display 48 is easily seen by a child operating the device. Additionally, a reset switch or reset botton 52 is positioned within reset switch hole 54. A speaker 56 is mounted in a speaker housing 58. The speaker housing 58 is positioned so that when speaker 56 is seated within speaker housing 58, speaker 56, will be aligned with a speaker hole or speaker grill 60, which is defined by beam 2.

When first beam part 4 and second beam part 6 are assembled, they cooperate to form a clamp member or bracket 62. An exercise bar 64, having a top portion 66, a handle 67, and a bottom portion 68, is supported by bracket 62 at bottom portion 68. Bracket 62 has side walls 70 and 72 which cooperate with exercise bar mount 74 and force adjustment means 76 to retard the movement of exercise bar 64 thereby, changing the force required to move the exercise bar 64.

Counting switch 35 and 30 are activated when operating detent 77, attached to bottom 68 of exercise bar 64, moves against spring member 79 and 81. This causes an electrical contact to be made in detectors 30 and 35 respectively.

A socket portion 78 is formed in beam 2 at first beam end 14. A second socket portion 80 is formed in beam 2 at the second end 16. Housing H defines a forward stop face 83. The second end 16 defines a rearward stop 85.

A first leg or foot 82 includes support bar 84 and projection portion or elbow portion 86. End 88 of projection portion 86 is configured so that it may be received by socket 78. Second leg 90 and support bar 91 includes projection portion or elbow portion 92 having an end 93. End 94 is configured so that it may be received within socket 80. First leg 82 preferably has associated therewith a first and second child's foot support 94 and 96 respectively. Associated with foot support 94 and foot support 96 are respective foot straps 98 and 100.

A seat 102 is slidingly mounted on beam 2 by means of a seat mount 104. Seat mount 104 has first and second side portions 106 and 108 respectively which each cooperate with closure bar 110 to keep seat 102 in an upright position on beam 2 and still allows seat 102 to slide freely along beam 2. At least one roller (not shown) may be provided between seat 102 and beam 2 to reduce friction as seat 102 slides along beam 2.

FIG. 10

Figure 10:
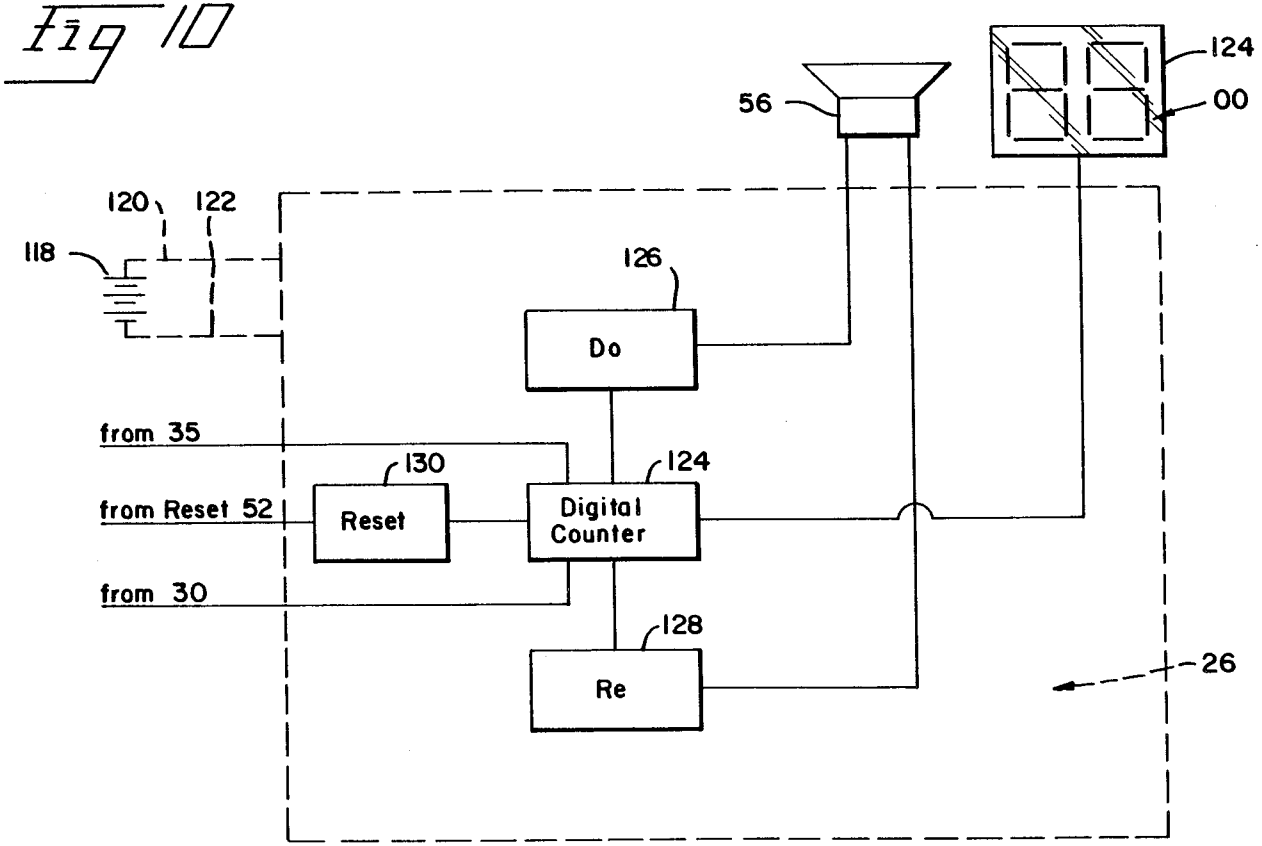
FIG. 10 is a schematic showing how the various electrical elements interrelate.

FIG. 10 shows, schematically, the interrelationship between various elements and the processing unit 26.

Battery 118 is connected to the processing unit 26 via terminals 120 and 122. The processing unit includes a digital counter or the like 124 which receives a signal from the counting switches 30 and 35. A signal from switch 35 activates Do signal means 126 which in turn causes speaker 56 to make a first sound. A signal from switch 35 activates Re signal means 128, which in turn, causes speaker means 56 to make a second sound. A signal from switch 35 also causes digital display 48 to display the number being displayed, up to ninty-nine. A reset signal means 130 receives a signal from reset button 52 and causes the digital counter to return to zero which in turn causes the digital display to display 00.

OPERATION

In operation a child sits down on the slidable seat 102. From this position, the child may adjust adjustment clamp knob 76 thereby, changing the force required to move exercise bar 64. Next, the child activates the electrical components by turning switch 40 in the on position and then pushing the reset button 52 to return the counter 30 and digital display 46 to 00. The child's feet may then be inserted between foot straps 98 and 100 and respective foot supports 94 and 96. The child is then ready to exercise or row by making the seat handle travel back and forth, and by moving exercise bar 64 and handle 67 between a first position 112 and a second position 114. Each stroke is signaled at both ends by a pleasing electronic tone produced by the speaker 56. Each time the exercise bar 64 reaches the first position 112, the digital display 46 displays the count of strokes. During the exercise, the seat 102 is free to move backwards and forwards between the first stop face 83 and second stop face 85 of the beam 2.

While this invention has been described as having a preferred design, it will be understood that it is capable of further modification. This application, is therefore, intended to cover any variations, uses, or adaptations of the invention following in general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. A child's exercise machine comprising:

(a) a beam member having first and second ends;

(b) first support leg having a projection portion;

(c) second support leg having a projection portion;

(d) first and second socket means, associated with respective said first and second ends for receiving respective first and second projection portions;

(e) an exercise bar movable between a first and a second position;

(f) a bracket member, associated with said beam member for pivotally supporting said exercise bar as said exercise bar moves between said first and seconds positions;

(g) a seat slidably mounted on said beam member;

(h) means for detecting when said exercise bar has reached said first position and for detecting when said exercise bar has reached said second position; and, (i) speaker means for producing a first sound when said detecting means has detected that said exercise bar is in a first position and for producing a second sound when said detecting means has detected that said exercise bar is in a second position.

2. A child's exercise machine as in claim 1 further comprising:

(a) a sliding seat mount means, associated with said seat, for sliding relative to said beam thereby allowing said seat to move between said beams first and second ends.

3. A child's exercise machine as in claim 2, further comprising:

(a) a foot support mounted on each side of said beam member;

(b) straps associated with each of said foot supports.

4. A child's exercise machine as in claim 1, further comprising:

(a) means for adjustably retarding the movement of said exercise bar as said exercise bar moves between said first and second position.

5. A child's exercise machine as in claim 4 wherein:

(a) said means for retarding movement includes a clamping means, associated with said bracket member, for clamping a portion of said exercise bar wherein the movement of said exercise bar is retarded; and, (b) a clamp adjustment knob associated with said clamping means.

6. A child's exercise machine as in claim 1, wherein:

(a) said beam is formed of a first part having a plurality of protuberances; and, (b) a second part having slots for receiving said protuberances wherein, said protuberances snap into said slots.

7. A child's exercise machine as in claim 1, wherein:

(a) said beam is formed of a thermoplastic material;

(b) said exercise bar is formed of a theroplastic material; and, (c) said seat is formed of a thermoplastic material.

8. A child's exercise machine as in claim 1 further comprising:

(a) counting means, associated with said means for detecting, for counting the times said exercise bar has reached said first position; and, (b) display means associated with said means for counting for displaying the number of times said exercise bar has reached said first position.

9. A childs exercise machine as in claim 8, further comprising:

(a) a reset means for resetting said counting means.

10. A child's exercise machine as in claim 9, further comprising:

(a) a control processing unit including means for receiving a signal from said detecting means and actuating said sound means wherein, a first sound is produced when said exercise bar is in a first position and a second sound is produced when said exercise bar is in a second position; and, (b) means for receiving a signal from said counter means and actuating said display means.

11. A child's exercise toy comprising:

(a) a beam member having first and second ends and first and second socket portions associated with respective said first and second ends;

(b) first and second support legs each having a projection portion for mating with respective said first and second socket portions;

(c) a seat mounted on said beam;

(d) an exercise bar movable between a first position and a second position;

(e) a handle member associated with said exercise bar;

(f) a bracket member associated with said beam member for pivotally supporting said exercise bar as said exercise bar moves between said first and second positions;

(g) detecting means for producing a first signal when said exercise bar has reached said first position and for producing a second signal when said exercise bar has reached said second position;

(h) speaker means for producing at least one sound;

(i) display means for displaying at least one numeral;

(j) processing unit means for receiving signals from said detecting means and sending signals to said display means corresponding to said first position and, sending a first signal to said speaker means corresponding to said first position and a second signal to said speaker corresponding to said second position wherein said display means changes said display of at least one numeral and said speaker means produces a first sound corresponding to said first position and a second sound corresponding to said second position.

12. A child's exercise toy as in claim 11, further comprising:

(a) a power supply; and, (b) an on/off switch associated with said beam member.

13. A child's exercise toy as in claim 12, wherein:

(a) said beam member includes means for housing said detecting means, said speaker means, said display means, said power supply and said processing means.

14. A child's toy as in claim 11, wherein:

(a) said means for receiving signals from said detecting means and sending signals to said display means comprises a counter; and (b) said display means is a digital display.

15. A child's toy as in claim 14, further comprising:

(a) a reset means for resetting said counter;

(b) reset botton associated with said reset means for actuating said reset means.

16. A toy exercise device for children comprising:

(a) central tubular plastic support;

(b) support feet transverse to said central tubular plastic support having an elbow portion;

(c) socket means, associated with said central tubular plastic support, for receiving said elbow portion;

(d) exercise bar, movable between a first and a second position, integral with said central tubular portion;

(e) clamp means, integral with said central tubular portion for supporting said exercise bar;

(f) seat, slidable along said central tubular portion;

(g) counting means for counting a number of movements, of said exercise bar from said first position to said second position and said second position back to said first position;

(h) display means for displaying said number; and (i) speaker means for producing a first sound when said exercise bar is moved from said first position to said second position and for producing a second sound when said exercise bar is moved from said first position to said second position.

17. A toy as in claim 16, further comprising:

(a) housing means for housing said counting means, said display means and said speaker means, said housing means being integral with said central tubular plastic support.

18. A toy exercise device for children, as in claim 16, wherein:

(a) said central tubular plastic support includes a forward and rearward seat stop integral therewith.

* * * * *